US008690004B2

(12) United States Patent
Cruz

(10) Patent No.: US 8,690,004 B2
(45) Date of Patent: Apr. 8, 2014

(54) EXPANDABLE HIGH PRESSURE TANK FOR AIR COMPRESSOR

(76) Inventor: Paul Cruz, San Diego, CA (US)

( * ) Notice: Subject to any disclaimer, the term of this patent is extended or adjusted under 35 U.S.C. 154(b) by 0 days.

(21) Appl. No.: 13/487,970

(22) Filed: Jun. 4, 2012

(65) Prior Publication Data

US 2013/0320026 A1 Dec. 5, 2013

(51) Int. Cl.
*F17C 7/04* (2006.01)
*F17C 1/02* (2006.01)

(52) U.S. Cl.
USPC ..... 220/586; 220/581; 383/3

(58) Field of Classification Search
USPC ..... 152/502, 503, 504, 505, 506, 507, 508, 152/509, 510, 511, 512; 220/8, 81, 582, 220/583, 584, 585, 586, 587, 588, 589, 590, 220/591; 383/3; 417/234, 235; 206/522
See application file for complete search history.

(56) References Cited

U.S. PATENT DOCUMENTS

| | | | | | |
|---|---|---|---|---|---|
| 1,774,892 | A | * | 9/1930 | Kline | 152/506 |
| 1,836,902 | A | * | 12/1931 | Carnahan | 152/506 |
| 2,283,801 | A | * | 5/1942 | Fitz Gerald | 152/508 |
| 3,105,785 | A | * | 10/1963 | Kocher | 156/130.7 |
| 3,106,772 | A | * | 10/1963 | Holcombe | 29/429 |
| 3,256,649 | A | * | 6/1966 | Webb | 52/2.26 |
| 4,110,995 | A | * | 9/1978 | Marchaj | 62/48.1 |
| 4,372,533 | A | * | 2/1983 | Knaus et al. | 254/93 HP |
| 4,619,225 | A | | 10/1986 | Lowther | |
| 5,088,903 | A | | 2/1992 | Tomatsu | |
| 5,454,408 | A | | 10/1995 | DiBella | |
| 5,458,258 | A | | 10/1995 | White | |
| 5,632,146 | A | | 5/1997 | Foss | |
| 5,787,920 | A | | 8/1998 | Krasnov | |
| 6,044,954 | A | | 4/2000 | McLaughlin | |
| 6,062,313 | A | | 5/2000 | Moore | |
| 6,321,775 | B1 | | 11/2001 | Hildebrand | |
| 6,547,189 | B1 | * | 4/2003 | Raboin et al. | 244/158.3 |
| 6,584,781 | B2 | | 7/2003 | Bishop | |
| 6,607,012 | B2 | | 8/2003 | Yquel | |
| 6,725,671 | B2 | | 4/2004 | Bishop | |
| 7,152,637 | B2 | | 12/2006 | Hoke | |
| 7,210,496 | B2 | | 5/2007 | Suzuki | |
| 7,257,952 | B2 | | 8/2007 | Bishop | |
| 7,401,761 | B2 | | 7/2008 | Gardner | |
| 7,757,621 | B2 | | 7/2010 | Breivik | |
| 7,909,584 | B2 | | 3/2011 | Etter | |
| 2003/0039554 | A1 | | 2/2003 | Krasnov | |
| 2004/0108014 | A1 | | 6/2004 | Immel | |
| 2004/0159352 | A1 | | 8/2004 | Friedlmeier | |
| 2004/0232016 | A1 | * | 11/2004 | Dietrich | 206/315.3 |
| 2006/0027276 | A1 | * | 2/2006 | Main | 138/93 |
| 2011/0036848 | A1 | | 2/2011 | Landeck | |

* cited by examiner

*Primary Examiner* — Steven A. Reynolds
*Assistant Examiner* — Javier A Pagan
(74) *Attorney, Agent, or Firm* — Law Offices of David L. Romero

(57) ABSTRACT

The present invention is directed, in part, to an apparatus and methods related to an expandable storage tank for compressed gas, the storage tank prepared from a puncture resistant, flexible fabric material in which the storage tank is expandable to a desired volume when inflated and when deflated. During periods of non-use the storage tank is retracted in a compact and folded manner to save space compared to when the tank is inflated. The storage tank is utilized by employing its use in conjunction with a traditional air compressor and can be configured with or without a rigid outer shell that expands in relation to the amount of compressed air transferred into the expandable storage tank.

7 Claims, 9 Drawing Sheets

EXPANDABLE HIGH PRESSURE TANK FOR AIR COMPRESSOR

FIELD OF THE INVENTION

The present invention relates generally to an improved method and apparatus for storage of compressed air. More specifically, the invention relates to storage tanks that expand to accommodate varying volumes of compressed air and which allow for easier and more efficient storage of air compressor equipment.

BACKGROUND OF THE INVENTION

Traditionally, compressors have required a significant amount of space in order to accommodate the size and bulk of most compressors and air storage tanks In addition, the significant weight associated with traditional compressor tanks makes portability difficult for industrial applications. However, air compression tanks require sufficient strength to withstand the pressures of containing sufficient gas for practical use both in a home setting as well as in an industrial setting. Manufacturing facilities often use compressed air as a means to power tools, conveyers, machines and other production equipment.

Demand for compressed air by various industrial equipment often taxes the available space in any particular workspace. Similarly, in home use of air compressors often results in tradeoff considerations in space saving wherein the user runs a risk of not having enough compressed air for his needs, or sacrificing space to house bulky compressor tanks to ensure sufficient compressed air is available for his purposes.

The benefits of readily available compressed air are numerous and previous inventions have attempted to address the need of making a more space saving and portable air compressor available to the general public. For example, U.S. Pat. No. 5,458,258 describes a storage tank for compressed natural gas that employs a hydroxy-phenoxyether polymer barrier liner. The invention however, still requires a large rigid outer shell for storage of natural gas. In addition, the materials required to synthesize the inner lining material can be prohibitively expensive making such a device financially untenable for the average user.

Likewise, U.S. Pat. No. 5,787,920 describes tank components, for storage of natural gas, that are constructed separately, preferably by extrusion, in which one section of the tank shell is composed of cylindrical portions that are fitted into an outer shell. Again, as described, the tank requires a rigid outer shell in order to accommodate the stored and compressed gas and thus, fails to address the need for more efficient use of space and portability.

U.S. Pat. No. 6,044,954 describes a dual vacuum and air compressor that provides compressed air for tire inflation and a vacuum for cleaning operations at a single location. The device is also described as being connected to an air reservoir however, the device is stationary and there is no ability to transport the device where it is needed.

U.S. Pat. No. 6,607,012 to Yquel describes a receptacle and apparatus for refilling the receptacle with compressed air. As described therein, the patent illustrates the device which contains a flexible inner bag that may be refilled. Similar to other devices in the art, the invention requires a hard outer shell for proper containment of the compressed air and further, this device employs the use of liquid for dispensing air in the manner described.

U.S. Pat. No. 6,725,671 describes a method and apparatus for transporting compressed gas that includes a gas storage system having a plurality of pipes connected by a manifold wherein the gas is stored at an optimum compressibility factor range for a given composition of gas. The invention however employs a series of pipes situated within a single "bull vessel", a device again lacking the portability sought in the art.

Accordingly, difficulties in the field of gas compression equipment, remain. Further, existing solutions fail to address particular deficiencies that confront businesses and consumers seeking alternatives to the existing art and a solution to advancing portability and space saving measures for gas compressors remains elusive. The present invention addresses these shortcomings.

SUMMARY OF THE INVENTION

The present invention is directed to an expandable storage tank for compressed air, the storage tank prepared from a puncture resistant, flexible fabric material in which the storage tank being expandable to a desired volume when inflated and when deflated. During periods of non-use the storage tank is retracted in a compacted manner to save space compared to when said tank is inflated. The storage tank is utilized by employing its use on conjunction with a traditional air compressor and can be configured with or without a rigid outer shell that expands and is adjustable in relation to the amount of compressed air transferred into the expandable storage tank.

DETAILED DESCRIPTION OF THE INVENTION

Figure 1:
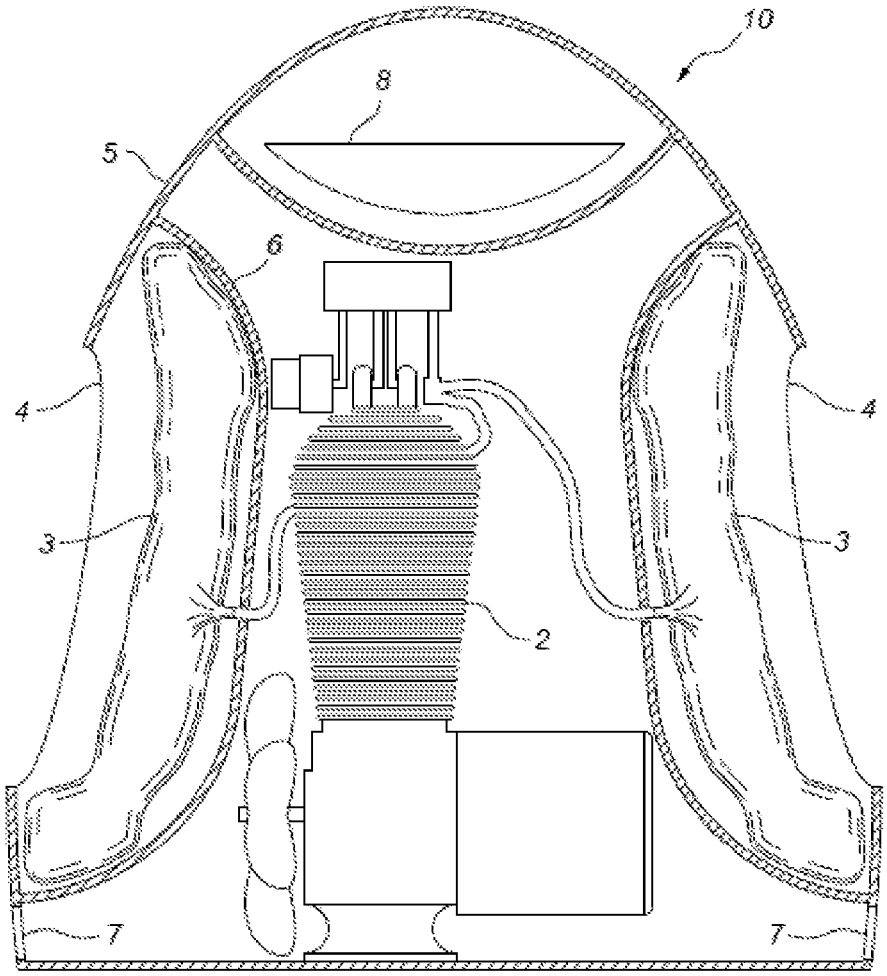
FIG. 1 depicts the basic configuration of invention. As illustrated, the invention is shown with two expandable bags deflated and stored adjacent to one another in a compact manner within an outer casing surrounding the air compressor.

The present invention provides an apparatus and methods that employ an expandable storage tank for compressed air or other gas types, the storage tank prepared from a puncture resistant, flexible fabric material in which the storage tank can be expanded to a desired volume when inflated and can be easily deflated for easy and compact storage. During periods of non-use the storage tank is retracted in a compacted manner to save space compared to when the tank is inflated. The storage tank is utilized by employing it in conjunction with a traditional air compressor.

In addition, the storage tank of the present invention is employed with an exterior adjustable, rigid shell that regulates the volume of compressed air contained within the inflated tank. As described herein, the exterior rigid shell is adjustable to vary the volume of compressed air contained within the inflated tank.

It is therefore, a primary object of the present invention to provide a composition and methods that effectively convey the convenience of a traditional air compressor while also providing portability and easy storage of the compressor. The invention allows the user the ability to deflate the storage tanks and retract them into a compact space until such time that compressed air is needed again.

In a preferred embodiment of the invention, a flexible, puncture resistant material is employed as the expandable storage tank. The tank will be prepared in a single or dual layer, however may be prepared in multiple layers to accommodate greater gas pressures. In a preferred embodiment the material will also be self-sealing thus allowing the tank to remain filled without the risk of explosion when punctured by any sharp objects. As envisioned herein, the expandable storage tanks are capable of storage pressures ranging from 200 to 6000 psi depending on the needs of a user. The tank of the present invention however, is capable of storing compressed gas at a pressure of at least 200 psi.

In addition, the expandable storage tanks can be prepared in a variety of sizes and volumes to provide either large or small amounts of compressed gas, again, depending on the needs of an individual user. The expandable storage tank also employs a self-sealing feature in which punctures in the tank are sealed by sealants and materials in order to prevent deflation or explosion of the tank in the event the tank is inadvertently punctured.

As envisioned herein, in another preferred embodiment, the invention also employs an adjustable rigid outer shell designed to house the flexible, expandable storage tank. Specifically, the outer shell will be configured in two primary elements, one section housing the air compressor and the other, an adjustable section, designed to house the storage tank as it is expanded and inflated by the air compressor.

The adjustable section of the outer shell can be adjusted to accommodate varying volumes so to regulate the expandable tank to a desired volume. For example, in instances wherein only a small amount of compressed air is needed, the outer shell can be adjusted so that the volume of the outer shell occupies no more than 2 cubic meters for instance. Accordingly, when the storage tank is inflated within the outer shell, the volume of the expandable storage tank will likewise occupy no more than 2 cubic meters of volumetric space. In cases in which more compressed gas it required, the outer shell can be adjusted to a greater volume which will allow the expandable storage tank to be filled to a likewise volume.

The invention as envisioned herein will be utilized with or without the outer shell elements described above. For workplaces in which a constant volume of compressed air is needed, the outer shell will not be necessary and can be omitted from the air compressor configuration. The outer shell will also be adjustable in order to allow easy and efficient storage of the air compressor in times of non-use. For example, the adjustable outer shell can be completely compacted so that it occupies very little space.

The outer shell can be assembled in a variety of configurations as illustrated herein. As envisioned, the expandable storage tank will fit adjacent to the outer shell and attached to a traditional air compressor. As illustrated herein, the invention will fill the inner portion of the adjustable section of the outer shell to a desired volume of compressed air. Furthermore, the air compressor can be fitted and configured to employ use of one or more expandable storage tanks simultaneously.

The outer shell can be assembled and prepared from any materials as known in the art including but not limited to aluminum, thermoplastics, steel or other rigid metals that can be machined into the shell described.

Turning now to the substance of FIGS. 1 to 22 and the preferred embodiments of the invention. FIG. 1 provides a side view perspective of a preferred embodiment of the present invention. Specifically, the air compressor equipment and apparatus embodiment 10 is made up of a rigid outer shell 5, a compressor motor 2 and the expandable storage tanks 3 that when inflated, exit openings 4 in the outer shell to accommodate greater volumes of air contained within the tanks The compressor compartment is separated from the storage tank area by a barrier 6 that keeps the motor apart from the tanks As shown in FIG. 1, ventilation openings 7 allow the compressor to expel exhaust gas during periods of use. The outer shell is also fitted with a convenient handle 8 to allow a user greater portability of the device.

Figure 2:
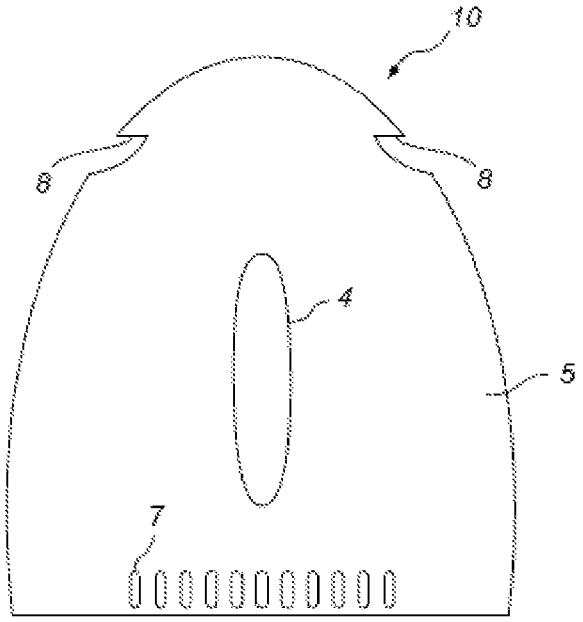
FIG. 2 depicts a profile perspective of the outer shell surrounding the air compressor and expandable storage bags. As illustrated, the rigid outer shell is adjustable in order to vary the degree that the expandable bags (not shown) are inflated.

FIG. 2 is a different perspective of the embodiment of FIG. 1. Specifically, as shown, the rigid outer shell 5 includes ventilation openings 7 at the lower portion of the rigid outer shell. An opening 4 to allow the expandable storage tank therethrough when filling is shown. A handle 8 allows for convenient portability.

Figure 3:
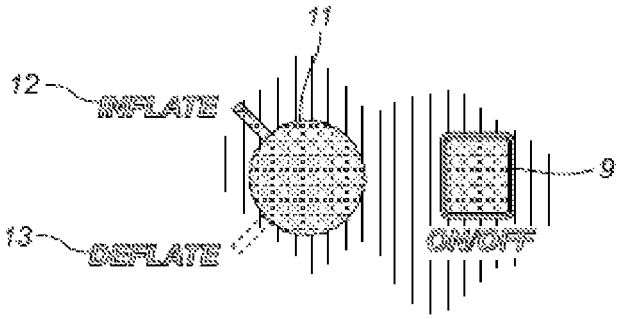
FIG. 3 depicts a switch in which the air compressor controls the deflation and inflation of the expandable storage bags of the invention through the use of a valve switch as well as power controller.

FIG. 3 illustrates the actuating switch 9 of the invention in which a user may either inflate or deflate the expandable bags by switching a valve 11 on the compressor accordingly to either generate compressed air 12 or to evacuate air 13.

Figure 4:
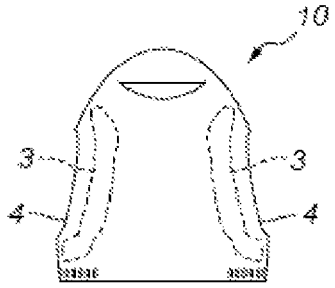
FIG. 4 illustrates an outer shell in which the expandable bags are stored within and are in a deflated state.

FIGS. 4, 5, 6 and 7 illustrate progressive inflation of the expandable storage tanks as they are employed in the first preferred embodiment of the invention. Specifically, FIG. 4 shows a side view perspective of the compressor contained within the rigid outer shell. The illustration shows the invention as depicted when the storage tanks are completely empty and in a deflated condition.

Figure 5:
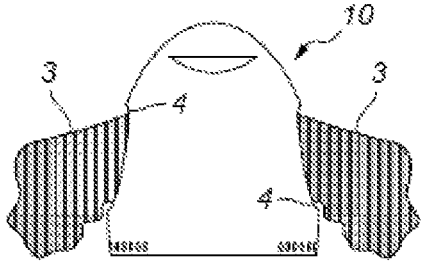
FIG. 5 illustrates the expandable bags as they begin to inflate. As shown, the bags are half filled and begin to exit the outer shell containing an air compressor through openings in the shell body.

FIG. 5 illustrates a side view perspective of a preferred embodiment of the invention. Specifically, the expandable storage tanks 3 are partially filled and pass through openings 4 located on the rigid outer shell and compressor. As the storage tanks fill with compressed air generated from the compressor motor the storage tanks occupy space outside the outer shell.

Figure 6:
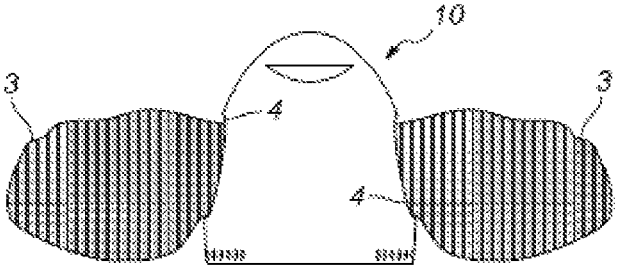
FIG. 6 illustrates the expandable bags as they are nearly fully inflated. As shown, the storage bags are inflated with an air compressor located within the outer shell and begin to occupy space to accommodate the air stored within the expandable bags.

FIG. 6 illustrates a side view perspective of a preferred embodiment of the invention. Specifically, the expandable storage tanks 3 are partially filled and pass through openings 4 located on the rigid outer shell and compressor. As the storage tanks fill with compressed air generated from the compressor motor the storage tanks occupy a greater amount of space outside the outer shell.

Figure 7:
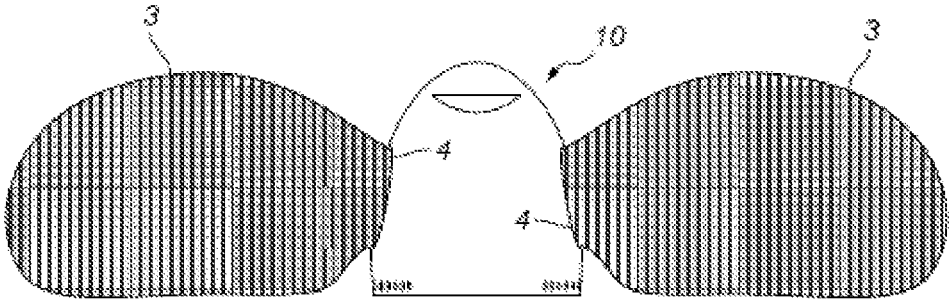
FIG. 7 illustrates the expandable bags of the invention as they are fully inflated. As shown, the storage bags have fully inflated via an air compressor located within the rigid outer shell.

FIG. 7 illustrates a side view perspective of a preferred embodiment of the invention. Specifically, the expandable storage tanks 3 are shown completely filled. In the illustration the storage tanks pass through openings 4 located on the rigid outer shell and compressor.

Figure 8:
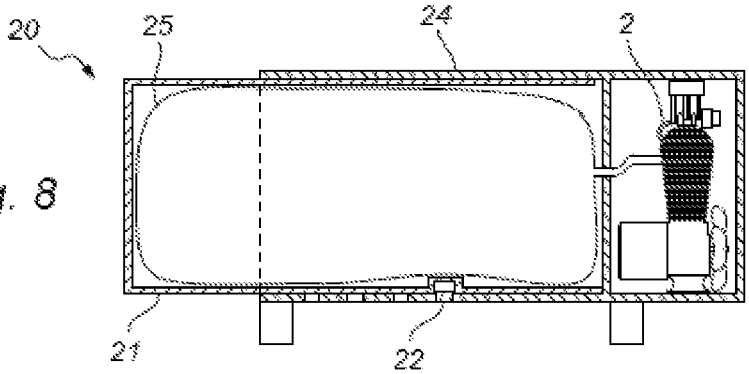
FIG. 8 illustrates an alternative embodiment of the invention. As shown, at right is a traditional air compressor configured adjacent to a rectangular casing that houses the inflating expandable bag as it is inflated. The casing is adjustable and can vary the volume in which the expandable bag is filled.

FIG. 8 illustrates a side view perspective of an alternative embodiment 20 of the present invention. Specifically, as shown, the outer shell in the illustration is an adjustable compartment that includes a stationary section 24 and an adjustable section 21. In order to adjust the desired volume, an adjustment button 22 is engaged to allow a desired volume into the expandable tanks As shown, the expandable storage tank 25 is partially inflated and occupies volume within the outer shell.

Figure 9:
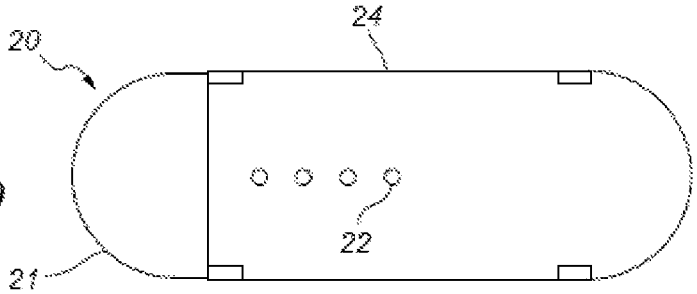
FIG. 9 illustrates an alternative embodiment of the invention. Specifically, an adjustable outer shell housing an air compressor (not shown) is illustrated. Adjustment buttons (22) allow the rigid shell to be expanded or narrowed in order to regulate the volume with which the expandable storage tanks encompass.

FIG. 9 illustrates a side view perspective of an alternative embodiment 20 of the present invention. A compressor (not shown) is situated within an expandable compartment 21 that includes an adjustable section of the outer shell and adjustment buttons 22 that allow a user to regulate the volume occupied by the expandable storage tanks of the invention.

Figure 10:
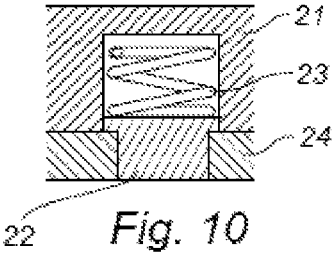
FIG. 10 illustrates a valve switch, which when engaged, allows filling and expansion of the expandable storage tanks with compressed air. As shown, the switch is not engaged.

FIG. 10 depicts a valve switch/button 22 located on the compressor motor on a stationary portion of the compressor motor that allows either inflation or deflation of the expandable storage tanks with a valve spring 23. The valve spring is configured within the expandable portion of the air compressor tank. As shown, the switch is not engaged.

Figure 11:
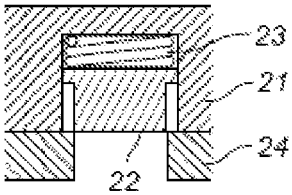
FIG. 11 illustrates a valve switch shown in an engaged configuration. In this configuration, the switch actuates a valve that allows the expandable storage tanks of the invention to be filled with compressed air.

FIG. 11 depicts a valve switch/button 22 located on the compressor motor on a stationary portion of the compressor motor that allows either inflation or deflation of the expandable storage tanks with a valve spring 23. The valve spring is configured within the expandable portion of the air compressor tank. As shown, the switch is engaged.

Figure 12:
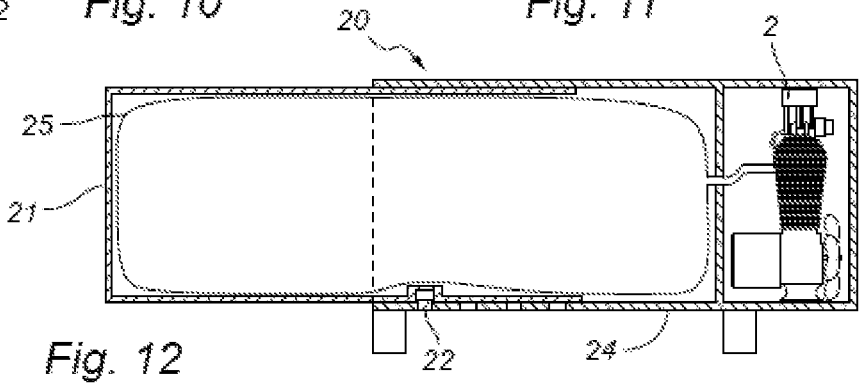
FIG. 12 relates to FIG. 8 and illustrates expansion of the rigid shell as the inner expandable tanks are filled with compressed air to a desired volume. As shown, the expandable section of the outer shell (21) slidably expands to accommodate the expanding inner storage tank to a desired volume.

FIG. 12 illustrates a side view perspective of an alternative embodiment 20 of the present invention. Specifically, as shown and related to FIG. 8, the outer shell in the illustration is an adjustable compartment that includes a stationary section 24 and an adjustable section 21. In order to adjust the desired volume, an adjustment button 22 is engaged to allow a desired volume into the expandable tanks In the illustration, the expandable storage tank 25 is shown in a fully inflated configuration compared to FIG. 8 and the outer shell is adjusted to accommodate the greater volume required to house the tank.

Figure 13:
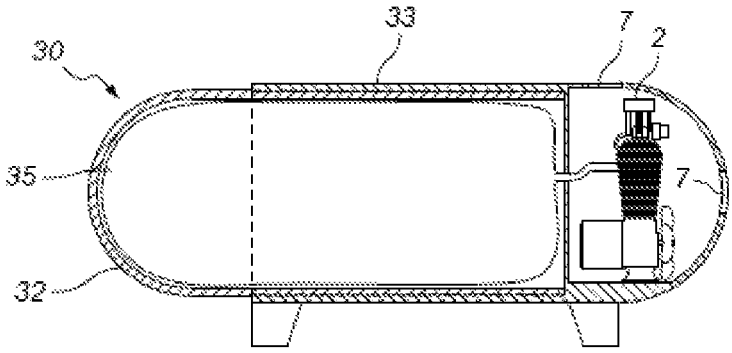
FIG. 13 relates to the embodiment of FIG. 9. As shown, the outer shell has an expandable section (32) that houses the air compressor and the inner expandable storage tank. The expandable section of the outer shell slidably adjusts to a desired length in order to vary the volume of the storage tanks.

FIG. 13 illustrates an alternative side view perspective of the invention 30. As shown, the embodiment includes a compartment that houses the compressor motor 2 within a rigid outer shell 33. Adjacent to the compartment is an expandable and adjustable section of the outer shell 32 that expands as the inner storage tank 35 to a desired volume. In the illustration, the expandable storage tank is shown partially filled by the compressor motor 2.

Figure 14:
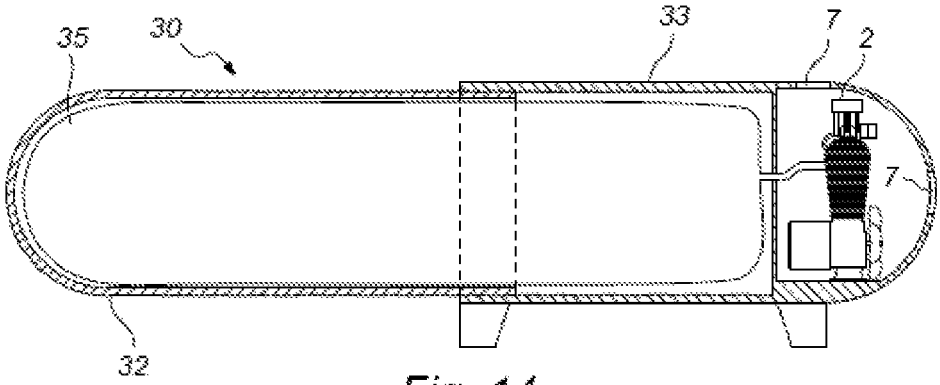
FIG. 14 illustrates expansion of both the expandable storage tank and the expandable section of the rigid outer shell. Specifically, as the inner expandable storage tank inflates, the outer shell is adjusted to allow filling of the tank to a specific desired volume.

FIG. 14 relates to FIG. 13 and illustrates an alternative side view perspective of the invention 30. As shown, the embodiment includes a compartment that houses the compressor motor 2 within a rigid outer shell 33. Adjacent to the compartment is an expandable and adjustable section of the outer shell 32 that expands as the inner storage tank 35 in fully inflated. In the illustration, the storage tank expands the volume of the adjustable section of the outer shell 32, allowing a larger volume of compressed air to be storage within both the storage tank and the rigid outer shell.

Figure 15:
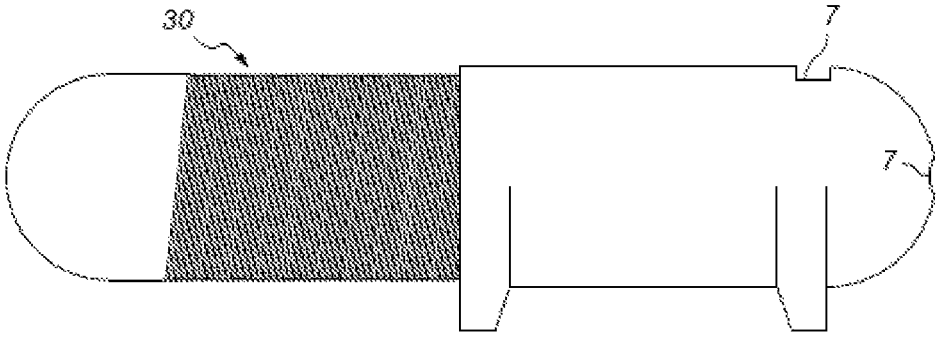
FIG. 15 illustrates an alternative embodiment of the outer shell, which houses the expandable storage tanks (not shown). Specifically, the expandable portion of the rigid outer shell is threaded to allow a user to adjust the volume in which the expandable tank is inflated.

FIG. 15 illustrates an alternative embodiment of the invention 30. As shown, the outer shell includes a threaded adjustable section that allows a user to vary the volume of compressed air that is stored in the expandable storage tanks (not shown). Also included are ventilation openings for the compressor motor.

Figure 16:
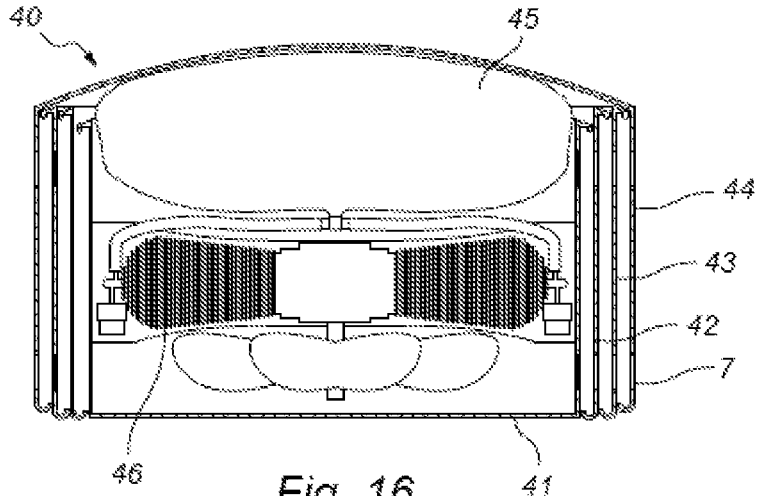
FIG. 16 illustrates an alternative embodiment of the invention. Specifically, a traditional air compressor is shown in the lower portion of an adjustable rigid outer shell with the expandable storage tank (45) configured above the compressor.

FIGS. 16, 17, 18 and 19 relate to a preferred embodiment of the invention 40. FIG. 16 illustrates the invention with the expandable storage tank 45 in a deflated configuration inside the upper section of the rigid outer shell 41. The compressor motor 46 is located at the lower portion of the stationary section of the outer shell 41. The adjustable section of the outer shell includes several elements 42, 43, 44 that allow the storage tank to expand as it is inflated.

Figure 17:
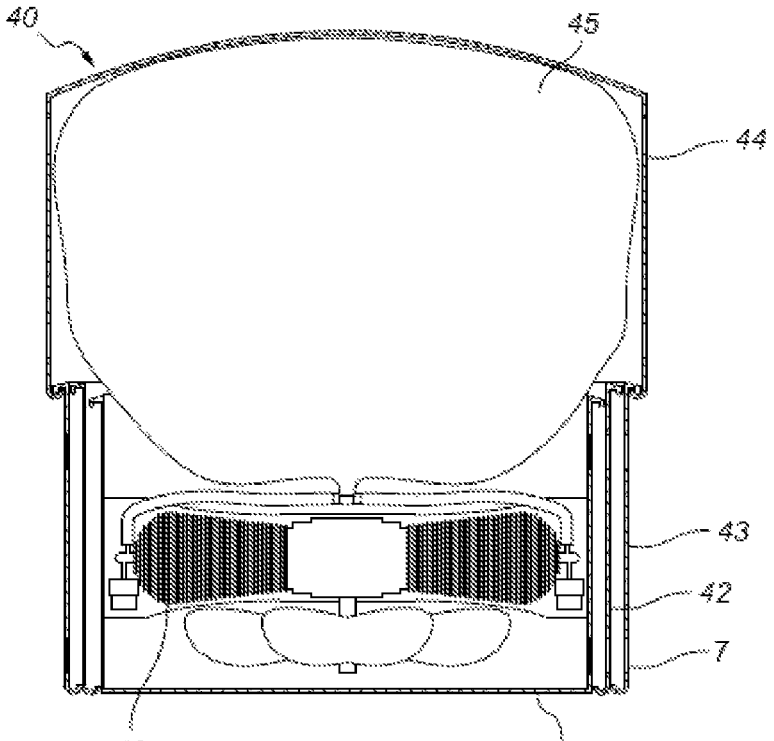
FIG. 17 illustrates an alternative embodiment of the invention wherein the expandable storage tank begins to fill with compressed air generated by the air compressor. As shown, the adjustable portion of the rigid outer shell can be adjusted to accommodate the expanding storage tank to a desired volume.

FIG. 17 illustrates the invention 40 with the storage tank 45 partially inflated with compressed air generated from the compressor motor 46. Specifically, an adjustable section 44 of the rigid outer shell is configured upward to accommodate the partially filled storage tank. Adjustable sections 42, 43 remain in the lowered position allowing further expansion of the storage tank if necessary. Ventilation openings 7 are situated around the outer shell.

Figure 18:
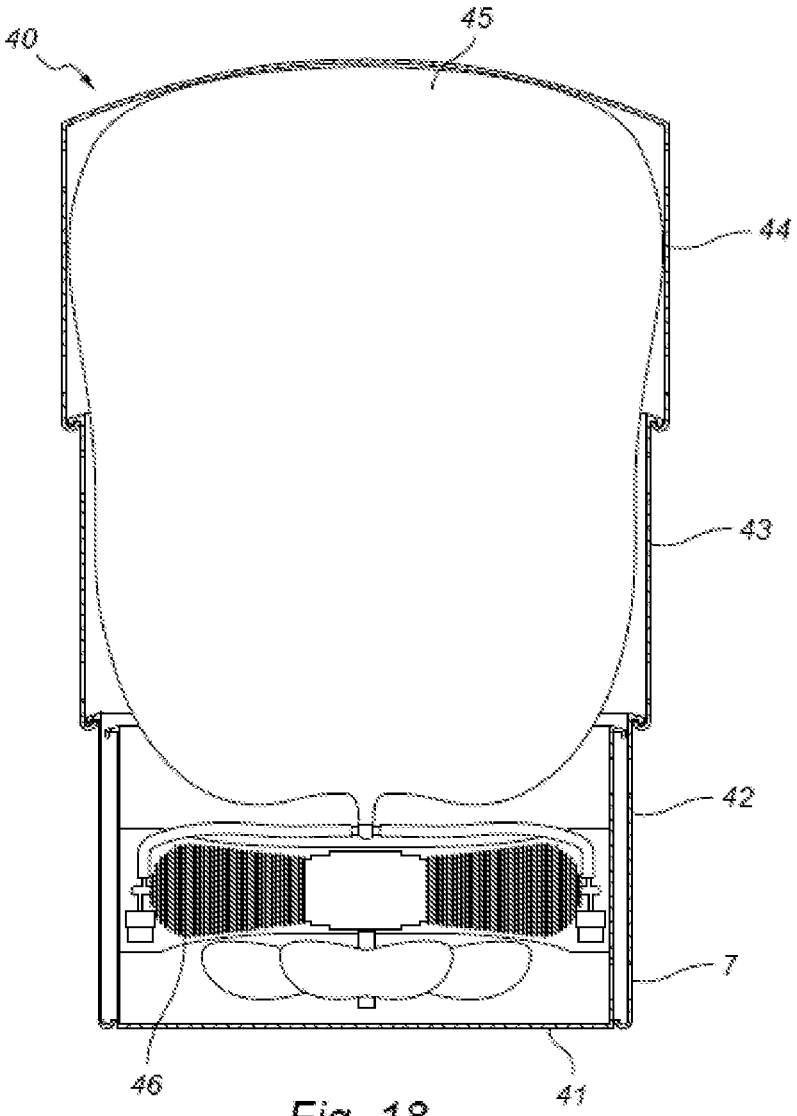
FIG. 18 illustrates the expandable storage tank of the invention as it is nearly completely filled with compressed air.

FIG. 18 illustrates the invention 40 with the storage tank 45 partially inflated with compressed air generated from the compressor motor 46. Specifically, two adjustable sections 43, 44 of the rigid outer shell are configured upward to accommodate the partially filled storage tank. An adjustable section 42 remains in the lowered position allowing further expansion of the storage tank if necessary.

Figure 19:
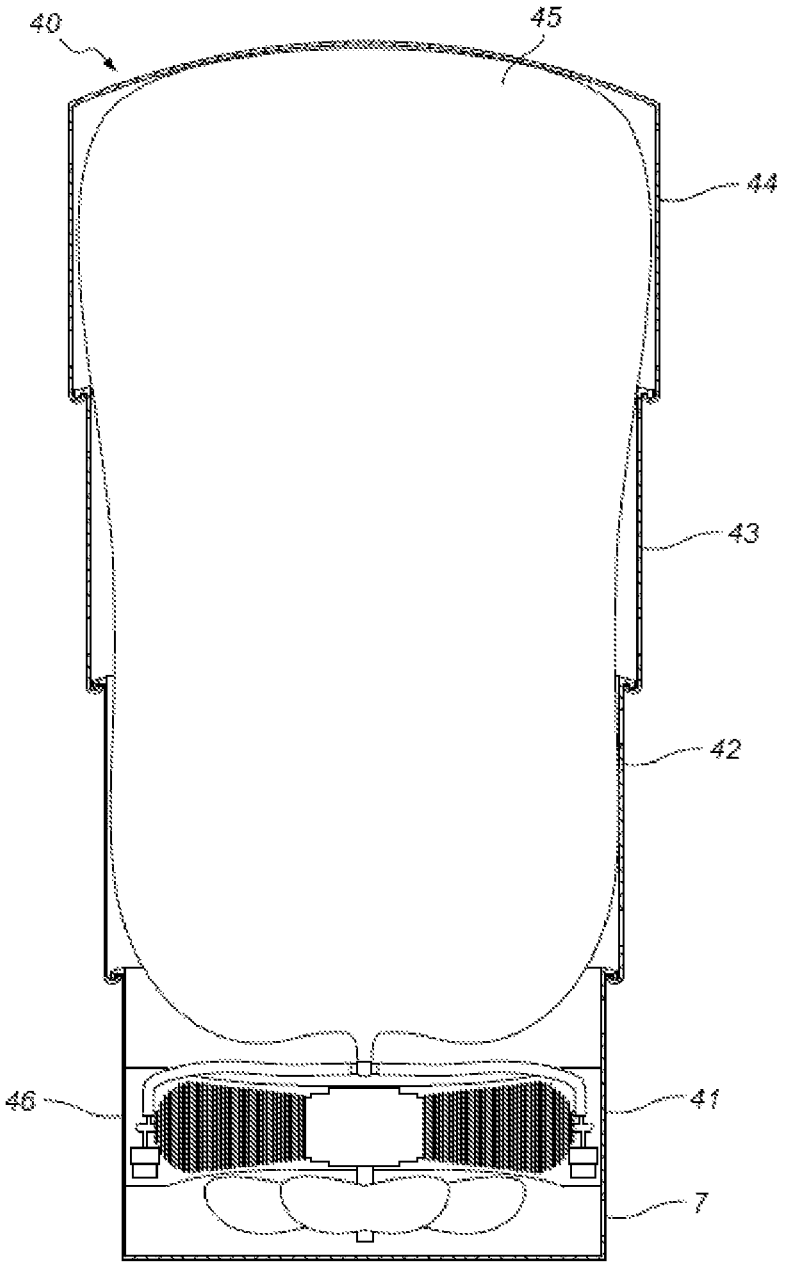
FIG. 19 illustrates the expandable storage tank of the invention in its fully inflated configuration. As shown, the adjustable outer shell is fully expanded providing the storage tank with a maximum volume of compressed air. Each section of the expanding outer shell may be locked into a particular range to limit the volume that the storage tank occupies depending on the needs of the user.

FIG. 19 illustrates the invention 40 with the storage tank 45 fully inflated with compressed air generated from the compressor motor 46. Specifically, all three adjustable sections 42, 43, 44 of the rigid outer shell are configured upward to accommodate the filled storage tank.

Figure 20:
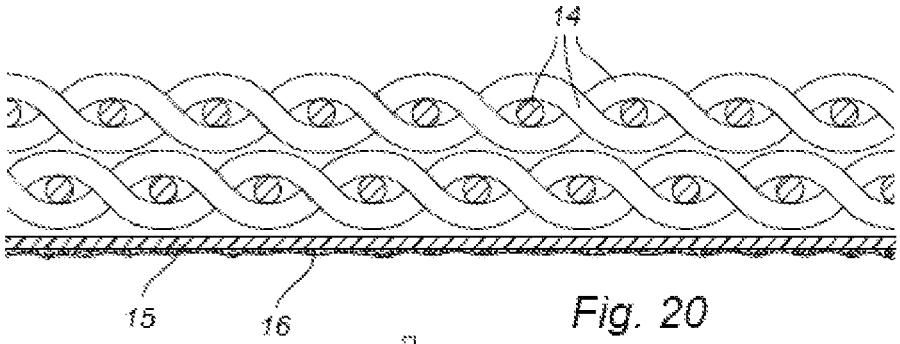
FIG. 20 illustrates the flexible, expandable material of the invention. As shown, the material can be a dual layer material and is flexible to allow the tank to be inflated and deflated as needed. As envisioned herein, the material may also be a single layer or multi-layered.
Figure 21:
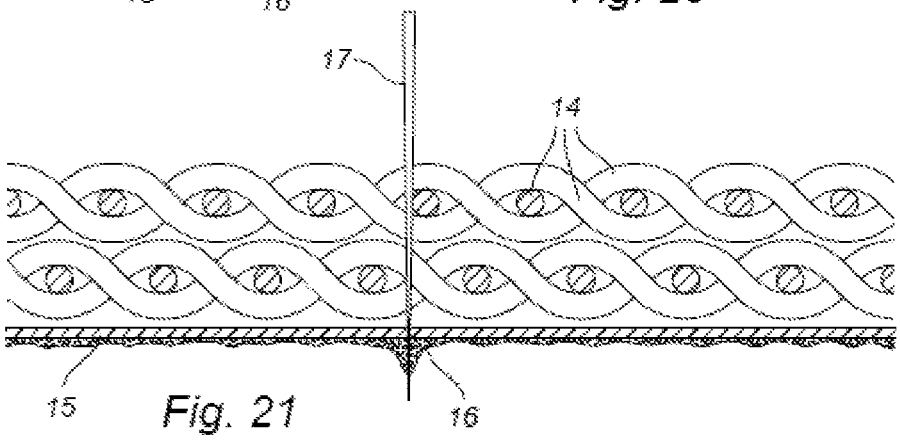
FIG. 21 illustrates the flexible, expandable material of the invention. Specifically, the material will be self-sealing and puncture resistant.
Figure 22:
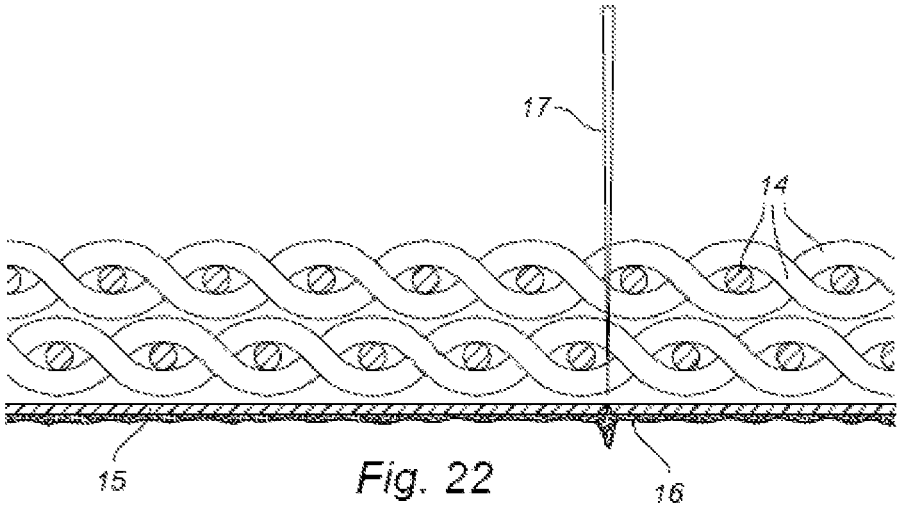
FIG. 22 illustrates the flexible, expandable material of the invention. As shown, the material will be puncture resistant and self-sealing allowing removal of sharp implements without breakage of the tank material.

FIGS. 20, 21, and 22 relate to the expandable storage tank of the invention. FIG. 20 illustrates materials that include dual, or multiple, woven outer layers 14 of the storage tank that are encompassed and envisioned within the scope of the invention. Also shown is the membrane of the storage tank 15 that includes a self-sealing material 16 that prevents puncture of the tank.

FIG. 21 illustrates the tank material as punctured by a sharp implement 17 through the tank membrane 15 and self-sealing material 16. FIG. 22 illustrates the storage tank material remains intact when the sharp implement 17 is removed from the tank membrane 15 and self-sealing material.

In a preferred embodiment of the invention the compressor can be configured in either a rigid outer shell or without, depending on the requirements of a user. Further, the outer shell, when employed, can be adjusted to allow different and varying degrees of expansion and inflation of the expandable storage tank thus, allowing a user to employ the compressor for small jobs or large depending on the needs of the user. As envisioned herein, various configurations of the rigid outer shell are employed to house the expandable storage tank that include various means of adjusting the volume in which the tank is filled.

To prepare the expandable air compressor storage tank, any puncture resistant fabric materials known in the art to withstand air compression pressures are encompassed within the scope of the present invention. Fabric materials include but are not limited to fiberglass and Kevlar composite fabric materials. Such materials are to be employed either in a single layer or may be double or multiply layered as needed in order to withstand greater compression pressures. Materials include those that are sufficiently flexible that when the storage tank is deflated, the material is amenable to being retracted and folded to take a smaller volume of space, versus when the tank is inflated, so that the tank may be stored in a compact manner. As envisioned herein, the storage tanks can be employed to accommodate and store compressed air, oxygen, nitrogen or other types of gasses, or combination of gasses. The expandable storage tank can be prepared with a release valve as means of releasing the gas within the tank by a user at a desired time.

Fabric materials can also include nylon, Kevlar composites, polyester, natural and synthetic fabrics woven in single, double, triple or more layers to prepare the expandable tank. Fabric materials can be prepared to include composites of materials in which ratios of materials are employed. For example, fiberglass material can be sewn in combination with Kevlar composites or geotextile materials in appropriate ratios to prepare an optimal, durable and flexible inflatable material for use in the invention. Ratios of materials can include any combination of materials including but not limited to, 5:95, 10:90, 15:85, 20:80, 25:75, 30:70, 35:65, 40:60, 45:55, 50:50, 55:45, 60:40, 65:35, 70:30, 75:25, 80:20, 85:15, 90:10, 95:5. In addition, combinations employing three or more materials with similar ratios as those described above are envisioned and within the scope of the present invention.

For manufacturing the rigid outer shell, materials such as those known in the art may be utilized. For example, ethylene-vinyl acetate copolymer is used however, other materials such as polyurethane, silicone resin, poly (vinyl acetate) and other appropriate materials including for example aluminum and other metal based alloys, may be used likewise. The shell can also be prepared using a more rigid material such as silicone based polymers or Teflon in which the material is molded at melting point temperatures and cooled to produce the necessary size of the spines.

Injection molding is accomplished by large machines called injection molding machines. Resin is fed to a machine through what is called a hopper. Colorants are fed to the machine directly after the hopper. The resins enter the injection barrel by gravity though the feed throat. Upon entrance into the barrel, the resin is heated to the appropriate melting temperature.

The resin is injected into the mold by a reciprocating screw or a ram injector. The reciprocating screw offers the advantage of being able to inject a smaller percentage of the total shot (amount of melted resin in the barrel). The ram injector must typically inject at least 20% of the total shot while a screw injector can inject as little as 5% of the total shot.

Certain advantages can be obtained in utilizing the present invention. Foremost, the invention allows a user to conserve space in the workplace by maintaining the expandable storage tank in a deflated manner thus, saving space. Moreover, the expandability of the storage tank allows a user to vary the volume of compressed air contained in the storage tank and thus, enables a user to fill the tank for small jobs or large depending on the needs of the job to be performed.

Benefits of the present invention over the prior art also include an increased degree of portability of air compressing equipment resulting in greater workspace for workers. In addition, portability of air compressor equipment is increased significantly due to the lightweight puncture resistant material utilized in the invention.

Although the invention has been described with reference to the above examples, it will be understood that modifications and variations are encompassed within the spirit and scope of the invention. Accordingly, the invention is limited only by the following claims.

What is claimed is:

1. An expandable storage tank attached to a traditional air compressor to generate and store compressed gas, the storage tank comprising a puncture resistant, self-sealing, flexible fabric material, wherein said flexible fabric material comprises one or more layers of fabric material, wherein said storage tank stores compressed gas at pressures between 200 and 6000 psi, the storage tank being expandable to a desired volume when inflated and when deflated, said storage tank being retractable to a compact configuration to save space compared to when said storage tank is inflated, wherein, said storage tank further comprises an exterior rigid shell that regulates the volume of said compressed gas contained within the storage tank wherein, said exterior rigid shell fully encapsulates said storage tank, wherein said exterior rigid shell is adjustable to vary the volume of compressed gas contained within the expandable storage tank to a desired volume wherein, said adjustment of volume is carried out by locking one or more buttons located on the exterior rigid shell, said buttons corresponding to a desired storage tank volume and interior pressure, the storage tank further comprising a gas compressor nozzle and pressure regulator, wherein said gas compressor nozzle attaches to and delivers said compressed gas to pneumatic power tools and equipment that require compressed gas for operability of said pneumatic tools and said equipment.

2. The storage tank of claim 1 wherein said puncture resistant material comprises at least one outer layer comprising a self sealing material and a membrane for maintaining said compressed gas in the storage tank wherein, said puncture resistant material stores compressed gas at pressures between 200 and 6000 psi.

3. The storage tank of claim 1 wherein said exterior rigid shell expands proportionately with the volume of the compressed gas contained in said storage tank wherein said exterior rigid shell is expanded by unlocking buttons located on the exterior rigid shell, said buttons corresponding to a desired storage tank volume and interior pressure.

4. The storage tank of claim 1 wherein said expandable storage tank may be inflated or deflated by engaging a valve which directs compressed gas in or out of said storage tank depending on the needs of a user.

5. The storage tank of claim 1 wherein said expandable storage tank comprises a geotextile fabric wherein said geotextile fabric stores compressed gas at pressures between 200 and 6000 psi.

6. The storage tank of claim 1 wherein said expandable storage tank comprises a Kevlar composite material.

7. The storage tank of claim 1 wherein said traditional air compressor is attached to one or more expandable storage tanks simultaneously.

* * * * *